US007192030B1

(12) United States Patent
Murphy

(10) Patent No.: US 7,192,030 B1
(45) Date of Patent: Mar. 20, 2007

(54) BALLGAME

(76) Inventor: Calvin L. Murphy, 3352 York Pl., Decatur, GA (US) 30032

( * ) Notice: Subject to any disclaimer, the term of this patent is extended or adjusted under 35 U.S.C. 154(b) by 148 days.

(21) Appl. No.: 10/897,820

(22) Filed: Jul. 23, 2004

Related U.S. Application Data

(60) Provisional application No. 60/490,736, filed on Jul. 29, 2003.

(51) Int. Cl.
*A63B 71/02* (2006.01)

(52) U.S. Cl. ..... 273/317; 473/415; 473/473

(58) Field of Classification Search ..... 273/317, 273/317.1, 317.5; 473/415, 473
See application file for complete search history.

(56) References Cited

U.S. PATENT DOCUMENTS

| | | | | | |
|---|---|---|---|---|---|
| 1,008,073 | A * | 11/1911 | Sato | 473/510 |
| 3,711,095 | A * | 1/1973 | Todd | 273/348 |
| 3,968,968 | A * | 7/1976 | Peterson | 473/473 |
| 4,355,813 | A * | 10/1982 | Rathjen | 473/473 |
| 4,523,762 | A * | 6/1985 | Garner, Sr. | 473/473 |
| 4,834,392 | A * | 5/1989 | Nixon | 473/473 |
| 5,018,746 | A * | 5/1991 | Cardoza et al. | 473/474 |
| 5,112,061 | A * | 5/1992 | Lamle | 473/473 |
| 5,630,589 | A * | 5/1997 | Adie et al. | 473/474 |
| 6,293,868 | B1 | 9/2001 | Bernard | |
| 6,312,348 | B1 | 11/2001 | Sandell | |
| 6,390,940 | B1 | 5/2002 | Naulls et al. | |
| 6,669,583 | B1 * | 12/2003 | Deppen | 473/474 |

* cited by examiner

*Primary Examiner*—Raleigh W. Chiu
(74) *Attorney, Agent, or Firm*—Sutherland Asbill & Brennan LLP

(57) ABSTRACT

A game of throw and catch where the object is for one team to get another team to drop or not catch a ball a predetermined number of times. A playing field has a first scoring area and a second scoring area distal from the first scoring area and an out-of-bounds area surrounding and between the first and second scoring areas. The first and second teams occupy the first and second scoring areas, respectively, and one of the teams attempts a scoring chance by throwing a ball from one of the first and second scoring areas across the out-of-bounds area toward another of the first and second scoring areas. A point is awarded if the scoring chance results in the ball landing untouched in the other of the first and second scoring areas or is touched and not caught by any of the one or more players on the other of the first and second teams before the ball lands on the field.

21 Claims, 1 Drawing Sheet

BALLGAME

CROSS-REFERENCE OF PRIOR APPLICATION

Figure 1:
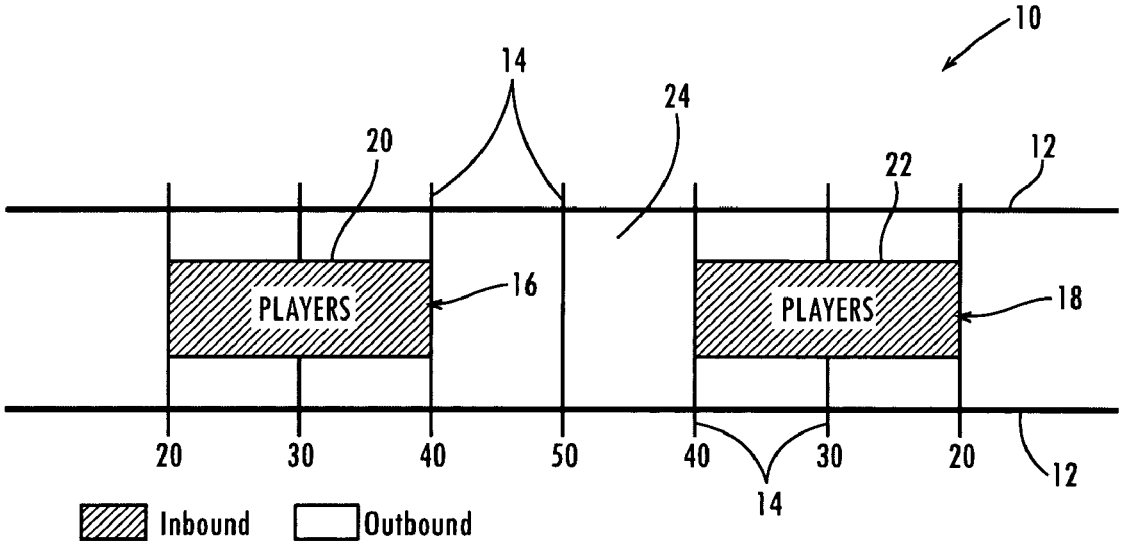

The present invention claims priority under 35 U.S.C. §119 to U.S. provisional patent application Ser. No. 60/490,736 filed Jul. 29, 2003.

TECHNICAL FIELD

This invention relates to a ballgame, more specifically, a game of throw and catch between two teams.

BACKGROUND OF THE INVENTION

Ballgames are traditionally a source of entertainment for participants and spectators. Some sporting events that are attended by spectators include an intermission during which additional entertainment is provided. Sometimes the additional entertainment during the intermission of a sporting event includes competition for prizes between spectators at the game. There remains a need for exciting and entertaining, but brief games for entertainment during the intermission of a sporting event.

SUMMARY OF THE INVENTION

The present invention encompasses a ballgame of throw and catch between two or more teams positioned in respective scoring areas separated by and surrounded by an out-of-bounds area, wherein the winner is determined by a number of drops incurred by the teams. Drops include an inbound, uncaught thrown ball against a receiving team, an out-of-bound thrown ball that is touched and uncaught by the receiving team, and a ball that is thrown out-of-bounds by a throwing team. The first two types of drops count against the receiving team and the last type of drop counts against the throwing team.

A preferred embodiment of the game of this invention can provide great entertainment during the intermission or half time of a sporting event such as a football game and can be a fast paced, fun and entertaining game of throw and catch. There is opportunity for laughter, fun, gifts, a showcase of skills, and promotion that gives fans another reason to come to a sporting event. In addition, in such a preferred embodiment, the game does not require a large capital outlay in setting up and overseeing the activity and requires a modicum of athletic ability and little or no specialized training or skill.

More particularly, this invention encompasses a method of playing a game including the following steps: providing a field which has a first scoring area bounded by a first scoring area boundary, a second scoring area bounded by a second scoring area boundary and located distal from the first scoring area, and an out-of-bounds area surrounding and between the first and the second scoring areas; providing a ball; positioning first and second teams of one or more players each in the first and second scoring areas, respectively; one of the one or more players on one of the first and second teams attempting a scoring chance by throwing the ball from one of the first and second scoring areas across said out-of-bounds area toward another of the first and second scoring areas; and awarding a point if the scoring chance results in the ball either landing untouched by at least the one or more players on another of said first and second teams in the other of the first and second scoring areas or is touched by any one of the one or more players on the other of said first and second teams and not caught by any one of the one or more players on the other of the first and second teams before the ball lands on the field. Desirably, the steps of attempting a scoring chance and awarding a point are repeated until one of the first and second teams is awarded a total number of points equal to the predetermined amount. Alternatively, the game can be ended after having been played for a predetermined period of time. Desirably, the winner of the game is determined based on the number of points awarded. In a preferred embodiment, the winner is awarded a prize.

According to one embodiment of the invention, the game further comprises repeating the steps of attempting a scoring chance and awarding a point and alternating, between the first and second teams, the one of the first and second teams throwing the ball as the steps of attempting a scoring chance and awarding a point are repeated. The steps of attempting a scoring chance and awarding a point can be repeated until one of the first and second teams is awarded a total number of points equal to the predetermined amount.

More particularly, no point is awarded in the game if the ball is caught by at least one of the one or more players on the other of the first and second teams before the ball lands on the field. Desirably, if the ball is caught by at least one of the one or more players on the other of the first and second teams during a scoring chance before the ball lands on the field, one of the one or more players on the other of the first and second teams attempts another scoring chance from a position where the one or the one or more players on the other of the first and second teams caught the ball. Furthermore, if the ball is not caught by at least one of the one or more players on the other of the first and second teams during a scoring chance before the ball lands on the field and the point is awarded, one of the one or more players on the other first and second teams attempts another scoring chance from a position where the ball is placed by a referee, according to one embodiment of the invention. According to a particular embodiment, the ball is placed by a referee at a point which is deemed to be the point of first contact between the ball and either the ground or the player who attempted the catch. Desirably, if, during a scoring chance, the ball lands in the out-of-bounds area without being touched by any one of the more players on the other of the first and second teams, one of the players from the other of the first and second teams attempts a scoring chance from within the other of the first and second scoring areas.

According to a preferred embodiment, the ball is a football and the field is a football field and the first and second scoring areas are at least ten yards apart. Desirably, the first and second scoring areas are at least twenty yards apart.

According to a preferred embodiment, there are some limitations on attempting a scoring chance. For example, according to one embodiment, any player attempting a scoring chance is limited to a predetermined number of steps in any lateral or rearward direction before throwing the ball. Desirably, any player attempting a scoring chance must attempt the scoring chance before a predetermined period of time has elapsed. Optionally, the step of attempting a scoring chance includes passing the ball from one of the players on one of the first and second teams attempting a scoring chance to another of the players on the one of the first and second teams attempting the scoring chance. Another optional step is one of the first and second teams challenging a decision to award or not award a point. Desirably, the step of challenging is decided by a replay of the challenged decision on a replay screen and a vote by the game's general attendance.

Desirably, the players in the game are chosen through a qualification process consisting essentially of team members being able to throw a football at least twenty yards and the team members being able to catch of football. Desirably, the players are chosen from the game's general attendance by this qualification process, but alternatively, the players can be chosen prior to the sporting event at which the game is featured.

Other objects, features, and advantages of this invention will be understood by those skilled in the art from the following detailed description of embodiments, claims, and drawings.

BRIEF DESCRIPTION OF EMBODIMENT

FIG. 1 is a schematic diagram of a playing field in accordance with a preferred embodiment of this invention.

DETAILED DESCRIPTION OF EMBODIMENT

As summarized above, the ballgame of this invention is a game of throw and catch. Preferred embodiments of the game are described below with reference to FIG. 1, which illustrates a field of play.

The field 10 illustrated in FIG. 1 is a football field with sidelines 12 and yard markers 14, as ordinarily found on a football field. In addition, however, the field 10 has two scoring areas 16 and 18 bounded by respective scoring area boundaries 20 and 22. The first and second scoring areas 16 and 18 are distal from one another and separated and surrounded by an out-of-bounds area 24 covering the remaining football field and beyond.

Although FIG. 1 illustrates a football field, it should be understood that this game can be played on other types of ball fields including baseball fields, soccer fields, basketball courts, and the like, and can be located indoors or outdoors.

The scoring areas 16 and 18 are illustrated in FIG. 1 as being rectangular and ten yards by twenty yards, but it should be understood that the scoring areas can vary in size and shape. Also, although the first and second scoring areas 16 and 18 are separated by twenty yards in FIG. 1 and should be distal from one another, the scoring areas can be placed any distance apart, provided players on the respective teams can throw a ball from one of the scoring areas to another of the scoring areas.

The field 10 is desirably within a stadium with substantial seating capacity for spectators, as the game of this invention is particularly suitable for entertainment during the intermission or half time of a spectator sporting event. In particular, a game implemented according to a preferred embodiment of this invention can provide great entertainment during the intermission or half time of a spectator sporting event, such as a football game. Such an embodiment of this game can be a fast paced, fun and entertaining game.

First, teams of players are selected to play the game. The game is suited for at least two teams and each team can include one or more players, preferably three to five players. The teams can be selected before the sporting event at which the game is featured or can be chosen from spectators present at the sporting event. Any form of qualification scheme can be used, but a preferred qualification procedure for selecting players includes setting up a booth near an entrance to the stadium and interviewing potential candidates about their health, their ability to catch a ball, and their ability to throwing a ball at least a minimum distance, such as twenty yards. If selected, the contestant is instructed to meet at a predetermined time prior to intermission of the sporting event. The contestants may be asked to sign a waiver regarding responsibility for any health problems or injuries resulting from participation in the game.

The contestants can be given jerseys for the respective teams and protective gear such as knee pads and elbow pads. In addition, the teams can select a predetermined number of cheerleaders to cheer for the respective teams.

The ball used in the game is desirably a football, but other types of balls such as soccer balls, basketballs, volleyballs, baseballs, softballs, and the like can also be used.

To begin the game, the one of the two teams to throw the ball first is selected. The team throwing first can be selected by a game of chance such as a flip of a coin or some other method. The selection of the teams and administration of the game is conducted by at least two referees familiar with the rules of the game.

After selection of the team that is the first to throw, each team takes up positions in the respective scoring areas. The teams then take turns throwing the ball from one scoring area to the other while the team in the opposite scoring area attempts to catch the ball. The game is played until one team achieves a predetermined number of points or a predetermined time elapses from the start of the game.

Each team has a scoring chance when it is their chance to throw the ball from their scoring area to the opposite scoring area. A team scores a point anytime there is a drop. A drop includes a pass that is thrown by one team to another and uncaught by any player on the other team before the ball lands in the other team's scoring area. A drop also includes a pass that is thrown by one team to another team and lands on the field out-of-bounds uncaught after being touched by a player by the other team. Both of the foregoing types of drops count against the other team, which is the team receiving the pass. Another type of drop counts against the one team throwing the ball. This type of drop occurs when the team throwing the ball throws the ball, but the ball lands out-of-bounds before any player from the other team touches the ball.

The teams take turns at scoring chances beginning with the team initially selected to perform the first scoring chance. It is possible to play the game without alternating scoring chances between the two teams such as allowing one team to continue to take scoring chances as long as the other team does not catch the ball, but preferably, the two teams alternate scoring chances between each other.

According to a preferred embodiment, the first scoring chance is thrown by a player on the team selected to throw first from anywhere within that one team's scoring area. For example, the one player throwing the ball may choose to throw the ball from the forty yard line in FIG. 1. If the pass is caught by the other team before the ball lands on the field, a player from the other team can attempt their one scoring chance from the spot where the ball is caught. If the pass is not caught, the receiving team can throw the ball from anywhere in their scoring area including the forty yard line. If a ball is thrown out-of-bounds, the intended receiving team can throw the ball on the return scoring chance from anywhere in their scoring area. Any team member can throw or catch the ball, and optionally, one member on a team can thrown the ball to another member on the same team who may then throw the ball to the other team's scoring area.

Preferably, a player, when throwing the ball in a scoring chance, is allowed only five steps in a lateral or backward direction. Another maximum number of steps can be selected, but preferably the maximum number of steps during a scoring chance throw is five steps. If the player takes more than the maximum number of steps allowed during a scoring chance throw, the throw is forfeited and the other team obtains the ball and the next scoring chance. In such a situation, the other team can throw the ball from anywhere in their own scoring area.

The game desirably is limited to a maximum time which can be any selected time. Preferably, the game lasts from three to seven minutes. If the game remains tied at a predetermined point late in the game, both teams will then be allowed one throw to get ahead. If still a tied, the game ends in a tie. The team leading when the time expires wins.

The referees desirably determine all penalties and disputed plays and award points. Only the referee can stop the game clock during play, desirably during the first portion of play such as the first two minutes of the game. Each team has a predetermined number of chances to appeal any call with which they disagree. Desirably, the predetermined number of chances to appeal is one. On an appeal, a video replay of the disputed play can be viewed by the fans in the stadium on a video monitor and the fans in the stadium can decide such as by noise level of their cheering. Any challenge that is not overturned can count as a drop against the challenging team.

The number of drops that determine a winner can be any number, but three drops is the preferred number to determine the winner. This keeps the game within a reasonably short period of time during the intermission of the sporting events.

The winner of the game can be awarded one or more prizes and all contestants can be allowed to keep their jerseys and pads. The same can be applicable to the cheerleaders who can receive jerseys and prizes as well. Desirably, the performance of the game is accompanied by an audio commentator and perhaps a DJ to play music.

The game of this invention is an opportunity for fun and entertaining intermission or half time entertainment during a sporting event and gives fans another reason to come to the sporting event. According to the preferred embodiment of this invention, the game is a short, but an exciting two team sport that does not require a large capital outlay in setting up and overseeing the activity, and requires a modicum of athletic activity and no specialized training or skill. It can be used as a promotional event or charity fundraiser and can be a sponsored event.

It should be understood that the foregoing relates to particular embodiments of the invention, that numerous changes may be made without departing from the scope of the invention as defined in the following claims.

I claim:

1. A method of playing a game comprising the steps of:

providing a field which has a first scoring area bounded by a first scoring area boundary, a second scoring area bounded by a second scoring area boundary and located at least 10 yards from the first scoring area, and an out-of-bounds area surrounding and between the first and second scoring areas;

providing a ball;

positioning first and second teams of one or more players each in the first and second scoring areas, respectively;

one of the one or more players on one of said first and second teams attempting a scoring chance by throwing said ball from one of the first and second scoring areas across said out-of-bounds area toward another of the first and second scoring areas; and awarding a point if said scoring chance results in the ball either landing untouched by at least one of the one or more players on another of said first and second teams in the other of the first and second scoring areas or is touched by any one of the one or more players on the other of said first and second teams and not caught by any one of the one or more players on the other of said first and second teams before the ball lands on the field.

2. Method as in claim 1 wherein the steps of attempting a scoring chance and awarding a point are repeated until one of the first and second teams is awarded a total number of points equal to a predetermined amount.

3. Method as in claim 2 further comprising determining a winner based on the number of points awarded and awarding a prize to the winner.

4. Method as in claim 1 wherein the steps of attempting a scoring chance and awarding a point are repeated until one of the first and second teams is awarded a total number of points equal to a predetermined amount or the game has been played for a predetermined period of time.

5. Method as in claim 4 further comprising determining a winner based on the number of points awarded and awarding a prize to the winner.

6. Method as in claim 1 further comprising repeating the steps of attempting a scoring chance and awarding a point and alternating, between the first and second teams, the one of the first and second teams throwing the ball as the steps of attempting a scoring chance and awarding a point are repeated.

7. Method as in claim 6 wherein the steps of attempting a scoring chance and awarding a point are repeated until one of the first and second teams is awarded a total number of points equal to a predetermined amount.

8. Method as in claim 6 wherein the steps of attempting a scoring chance and awarding a point are repeated until one of the first and second teams is awarded a total number of points equal to a predetermined amount or the game has been played for a predetermined period of time.

9. Method as in claim 6 wherein, if the ball is caught by at least one of the one or more players on the other of the first and second teams during a scoring chance before the ball lands on the field, one of the one or more players on the other of the first and second teams attempts another scoring chance from a position where one of the one or more players on the other of the first and second teams caught the ball.

10. Method as in claim 6 wherein, wherein if the ball is not caught by at least one of the one or more players on the other of the first and second teams during a scoring chance before the ball lands on the field and the point is awarded, one of the one or more players on the other of the first and second teams attempts another scoring chance from a position where the ball is placed by a referee.

11. Method as in claim 10 wherein the ball is placed by a referee at a point which is deemed to be the point of first contact between the ball and either the ground or the player who attempted the catch.

12. Method as in claim 6 wherein, if, during a scoring chance, the ball lands in the out-of-bounds area without being touched by any one of the one or more players on the other of the first and second teams, one of the players from the other of the first and second teams attempts a scoring chance from any position within the other of the first and second scoring areas and the other team is awarded a point.

13. Method as in claim 1 wherein no point is awarded if the ball is caught by at least one of the one or more players on the other of the first and second teams before the ball lands on the field.

14. Method as in claim 1 wherein the ball is a football.

15. Method as in claim 14 wherein the field is a football field.

16. Method as in claim 1 wherein any player attempting a scoring chance is limited to a predetermined number of steps in any lateral or rearward direction before throwing the ball.

17. Method as in claim 1 wherein any player attempting a scoring chance must attempt the scoring chance before a predetermined time period has elapsed.

18. Method as in claim 1 wherein the step attempting a scoring chance optionally includes passing the ball from the one of the players on the one of the first and second teams attempting the scoring chance to another of the players on the one of the first and second teams attempting the scoring chance.

19. The method of claim 1 further comprising the optional step of one of the first and second teams challenging a decision to award or not to award a point.

20. The method of claim 19 wherein the step of challenging is decided by a replay of the challenged decision on a replay screen and a vote by a game's general attendance.

21. The method of claim 1 further comprising choosing the players from the game's general attendance by a qualification process, wherein the qualification process consists essentially of the team members being able to throw a football at least 20 yards and the team members being able to catch a football.

* * * * *